US010891840B2

(12) United States Patent
Wurmfeld et al.

(10) Patent No.: US 10,891,840 B2
(45) Date of Patent: Jan. 12, 2021

(54) SYSTEMS AND METHODS FOR MONITORING COMPONENTS OF AND DETECTING AN INTRUSION INTO AN AUTOMATED TELLER MACHINE

(71) Applicant: Capital One Services, LLC, McLean, VA (US)

(72) Inventors: David K. Wurmfeld, Falls Church, VA (US); Jeff Pharr, Herndon, VA (US); Kevin Osborn, Newton Highlands, MA (US)

(73) Assignee: Capital One Services, LLC, McLean, VA (US)

( * ) Notice: Subject to any disclaimer, the term of this patent is extended or adjusted under 35 U.S.C. 154(b) by 0 days.

(21) Appl. No.: 16/595,235

(22) Filed: Oct. 7, 2019

(65) Prior Publication Data

US 2020/0035079 A1 Jan. 30, 2020

Related U.S. Application Data

(63) Continuation-in-part of application No. 15/905,354, filed on Feb. 26, 2018, now abandoned, which is a continuation of application No. 15/903,880, filed on Feb. 23, 2018, now abandoned.

(51) Int. Cl.
*G08B 13/26* (2006.01)
*G07F 19/00* (2006.01)

(52) U.S. Cl.
CPC ..... *G08B 13/26* (2013.01); *G07F 19/205* (2013.01); *G07F 19/207* (2013.01); *G07F 19/2055* (2013.01)

(58) Field of Classification Search
CPC ..... G08B 13/26; G07F 19/205; G07F 19/207
See application file for complete search history.

(56) References Cited

U.S. PATENT DOCUMENTS 5,389,738 A 2/1995 Piosenka et al.
5,537,938 A 7/1996 Lopez, Jr.
5,598,793 A 2/1997 Lopez, Jr.
5,675,319 A * 10/1997 Rivenberg ..... G08B 13/128 340/540
7,926,710 B1 * 4/2011 Griswold ..... G06Q 20/1085 235/379

(Continued)

OTHER PUBLICATIONS

Communication and European Search Report dated May 14, 2019, issued from the European Patent Office in corresponding Application No. 19159229.4-1217 (8 pages).

*Primary Examiner* — James J Yang
(74) *Attorney, Agent, or Firm* — Pillsbury Winthrop Shaw Pittman LLP

(57) ABSTRACT

The disclosed embodiments provide systems, methods, and articles of manufacture for detecting an intrusion of a product (e.g., an ATM) via an electronic tattletale. The disclosed embodiments may provide an ATM comprising a housing comprising an interior surface and a substance adhered to the interior surface, the substance comprising a piezoelectric element. The ATM may further comprise a detection circuit coupled to the substance, which may be configured to receive a first response signal generated by the substance and generate an indication of an intrusion into the housing, based on a comparison of the received first response signal to a predefined second response signal.

18 Claims, 8 Drawing Sheets

(56) References Cited

U.S. PATENT DOCUMENTS

| | | | | |
|---|---|---|---|---|
| 2004/0046660 | A1 | 3/2004 | Ando | |
| 2005/0191757 | A1 | 9/2005 | Melker et al. | |
| 2006/0109114 | A1* | 5/2006 | Watts | G08B 29/20 340/568.1 |
| 2006/0167595 | A1 | 7/2006 | Breed et al. | |
| 2007/0138256 | A1* | 6/2007 | Coventry | G07F 19/20 235/379 |
| 2007/0216571 | A1 | 9/2007 | Joergensen | |
| 2009/0058628 | A1 | 3/2009 | Kirmayer | |
| 2011/0090658 | A1 | 4/2011 | Adams et al. | |
| 2011/0234387 | A1* | 9/2011 | Chaine | G07F 19/20 340/407.2 |
| 2012/0062241 | A1 | 3/2012 | Rossi et al. | |
| 2012/0062252 | A1 | 3/2012 | Rossi et al. | |
| 2014/0375481 | A1 | 12/2014 | McNicoll | |
| 2016/0154981 | A1* | 6/2016 | Wesselhoff | G06F 21/72 726/34 |
| 2016/0371946 | A1 | 12/2016 | Pantus | |
| 2017/0264599 | A1 | 9/2017 | O'Regan et al. | |

* cited by examiner

SYSTEMS AND METHODS FOR MONITORING COMPONENTS OF AND DETECTING AN INTRUSION INTO AN AUTOMATED TELLER MACHINE

CROSS-REFERENCE TO RELATED APPLICATIONS

This application is a continuation-in-part of and claims priority to U.S. patent application Ser. No. 15/905,354, filed Feb. 26, 2018, which is a continuation of U.S. patent application Ser. No. 15/903,880, filed Feb. 23, 2018. The contents of the above-referenced applications are expressly incorporated herein by reference in their entirety.

DESCRIPTION

Technical Field

The disclosed embodiments generally relate to device security and, more particularly, to systems, methods, and articles of manufacture for detecting intrusions into security products.

Background

An automated teller machine (ATM) is an electronic device that allows banking customers to carry out financial transactions without the need for a human teller. For example, customers may use an ATM to access their bank accounts, transfer funds, check account balances, or dispense items of value. Generally, to use an ATM, the customer may insert a banking card containing magnetic strip information into the ATM's card reader, and authenticate the card by entering a personal identification number (PIN). After the card has been read and authenticated, the customer can carry out various financial transactions.

While ATMs are convenient, their use can also be risky. Thieves often try to steal ATMs and/or break into them. After breaking into an ATM, thieves can access currency or checks held inside the ATM or manipulate the ATM's circuitry to dispense currency or checks automatically from the ATM.

Companies that manufacture or provide ATMs have made attempts to prevent thieves from breaking into ATMs or provide some detection of intrusion into an ATM to alert law enforcement to catch the thieves. Current mechanisms exist for detecting an intrusion into an ATM, such as using motion detectors, accelerometers, or the like, in particular zones inside of the ATM. These mechanisms are often referred to in the industry as "tattletales," mechanisms that "tattle," that is, notify third parties when an intrusions is detected.

Thieves are now able to bypass these mechanisms using new techniques. For example, thieves are using common tools, such as lower-power cutting or drilling tools, to break into ATMs. In some instances, thieves may use cutting or drilling tools to create a hole in the housing of an ATM. After creating the hole, thieves will introduce flammable materials, such as acetylene gas, into the case igniting the materials cause the case to expand and blow apart the housing allowing access to currency inside of the ATM.

Common drilling and cutting tools bypass the current mechanisms because they create little motion and/or sound. Quite often, the motion and sound generated by these tools are undetectable to current mechanisms. Moreover, companies choose to place mechanisms in particularize zones due, in part, to cost constraints. With this in mind, thieves intelligently choose where to drill the holes. That is, thieves often choose to drill holes far enough away from current mechanisms so that the current mechanisms fail to detect the intrusion.

In view of these and other shortcomings and problems with existing systems, improved systems and techniques for manufacturing secure products and detecting intrusion into secure products are provided that are inexpensive and mitigate the risks of capital loss from thieves.

SUMMARY

In the following description, certain aspects and embodiments of the present disclosure will become evident. It should be understood that the disclosure, in its broadest sense, could be practiced without having one or more features of these aspects and embodiments. It should also be understood that these aspects and embodiments are merely exemplary.

The disclosed embodiments address disadvantages of existing systems based on, at least, providing novel systems, methods, non-transitory computer-readable storage media, and articles of manufacture for detecting an intrusion into a secure device. Unlike prior implementations, the disclosed systems, methods, non-transitory computer-readable storage media, and articles of manufacture provide technical solutions that can be inexpensive (e.g., as related to the cost of the materials) and increase security (e.g., having the ability to detect an intrusion anywhere into the case and/or having the ability to detect intrusions that do not produce a lot of movement, vibrations, sound, etc.).

Consistent with a set of disclosed embodiments, an ATM is provided. For example, the ATM may comprise a housing comprising an interior surface; a substance adhered to the interior surface, the substance comprising a piezoelectric element; and a detection circuit coupled to the substance, the detection circuit being configured to: receive a first response signal generated by the substance; and generate an indication of an intrusion into the housing, based on a comparison of the received first response signal to a predefined second response signal.

Consistent with another set of disclosed embodiments, a method for detecting an intrusion into an ATM is provided. For example, the method may comprise applying a substance to an interior surface of a housing of the ATM, the substance comprising a piezoelectric element; coupling a detection circuit to the substance; receiving, using the detection circuit, a first response signal generated by the substance, and generating an indication of an intrusion into the housing, based on a comparison of the received first response signal to a predefined second response signal.

Consistent with yet another set of disclosed embodiments, a method for detecting an intrusion into an ATM is provided. For example, the method may comprise applying a substance to an interior surface of a housing of the ATM, the substance being applied as a coating on the interior surface to form a piezoelectric element; coupling a detection circuit to the substance; inducing, using the detection circuit, an input signal on the substance; receiving, using the detection circuit, a first response signal generated by the substance in response to the input signal, and generating an indication of an intrusion into the housing based on a comparison of the received first response signal to a predefined second response signal.

Aspects of the disclosed embodiments may also include a non-transitory tangible computer-readable medium that stores software instructions that, when executed by one or more processors, are configured for and capable of performing and executing one or more of the methods, operations, and the like, consistent with disclosed embodiments. It is to be understood that both the foregoing general description and the following detailed description are exemplary and explanatory only, and are not restrictive of the disclosed embodiments as claimed.

BRIEF DESCRIPTION OF THE DRAWINGS

The accompanying drawings, which are incorporated in and constitute a part of this specification, illustrate disclosed embodiments and, together with the description, serve to explain the disclosed embodiments. In the drawings.

DETAILED DESCRIPTION

Figure 1:
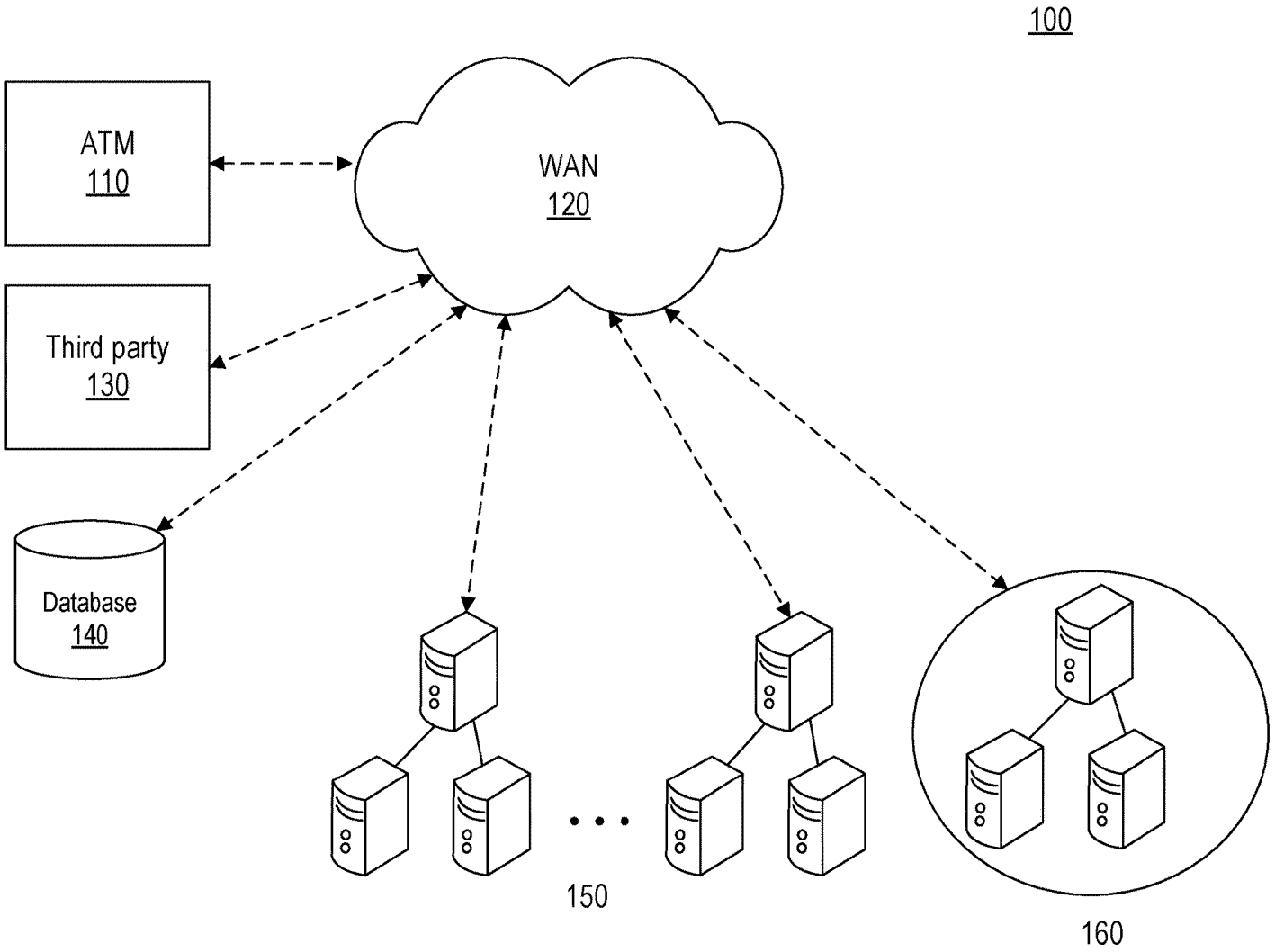
FIG. 1 is a block diagram of an exemplary system environment for providing an electronic tattletale consistent with disclosed embodiments.

The following detailed description refers to the accompanying drawings. Wherever possible, the same reference numbers are used in the drawings and the following description to refer to the same or similar parts. While several illustrative embodiments are described herein, modifications, adaptations and other implementations are possible. For example, substitutions, additions, or modifications may be made to the components illustrated in the drawings, and the illustrative methods described herein may be modified by substituting, reordering, removing, or adding steps to the disclosed methods. Accordingly, the following detailed description is not limited to the disclosed embodiments and examples. Instead, the proper scope is defined by the appended claims.

The disclosed embodiments generally relate to device security and, more particularly, to systems and methods for detecting intrusions into security products. As used herein the term "connected to" should be construed as touching, adhering to, resting on, attached to, fixed to, glued to, placed on, coupled, glancing, etc., and should be interpreted broadly.

FIG. 1 is a block diagram of an exemplary system environment 100 for providing an electronic tattletale consistent with disclosed embodiments. The components and arrangements, shown in FIG. 1, are not intended to limit the disclosed embodiments, as the components used to implement the disclosed processes and features may vary.

System environment 100 may include one or more automated teller machines (ATMs) 110, wide-area networks (WANs) 120, third parties 130, databases 140, server clusters 150, and/or cloud services 160. Other components known to one of ordinary skill in the art may be included in system environment 100 to gather, process, transmit, receive, acquire, and provide information used in conjunction with the disclosed embodiments. In addition, system environment 100 may further include other components that perform or assist in the performance of one or more processes that are consistent with disclosed embodiments.

An ATM may be construed as any machine that is capable of carrying out transaction instructions, which include the transfers of value. For example, ATM 110 may be a machine or device provided to allow cash withdrawals, deposits, transfer funds, or obtain account information. ATM 110 may be owned by or associated with a financial institution, such as a bank, a credit union, a savings or loan association, or the like. ATM 110 may be of a specific type of ATM, such as a specific brand or model. In some embodiments, other types of systems, devices, or products (not depicted) may replace ATM 110. For example, the disclosed embodiments may include any product that encloses any type of physical materials, systems, devices, products, and/or articles of manufacture. For example, a product may include any type of door, gate, lock, safe, etc.

ATM 110 may include one or more housings, fasciae, processors, memory devices, and/or circuits. The processors, memory devices, and circuits may work together, in different combinations, to dispense currency, accept deposits, make account balance inquiries, pay bills, transfer funds, and/or the like. ATM 110 may also dispense media, currency, and/or documents. These media and documents may include tickets, vouchers, checks, gaming materials, notes, receipts, etc. Users (e.g., customers, consumers, etc.) may operate ATM 110. In some embodiments, ATM 110 may be owned by and/or associated with merchants, merchant devices, financial service providers, and/or financial service provider devices.

WAN 120 may comprise any computer networking arrangement used to exchange data. For example, WAN 120 may be the Internet, a private data network, a virtual private network (VPN) using a public network, and/or other suitable connections that enable the components of system environment 100 to send and acquire information. WAN 120 may also include a public switched telephone network ("PSTN") and/or a wireless network such as a cellular network, wired Wide Area Network, Wi-Fi network, or another known wireless network (e.g., WiMAX) capable of bidirectional data transmission.

WAN 120 may also include one or more local networks (not pictured). A local network may be used to connect the components of FIG. 1, such as ATM 110, third party 130, database 140, server cluster 150, and/or cloud service 160, to WAN 120. A local network may comprise any type of computer networking arrangement used to exchange data in a localized area, such as Wi-Fi based on IEEE 802.11 standards, Bluetooth™, Ethernet, and other suitable network protocols that enable components of system environment 100 to interact with one another and to connect to WAN 120 for interacting with components in system environment 100. In some embodiments, a local network comprises a portion of WAN 120. In other embodiments, components of system environment 100 may communicate via WAN 120 without a separate local network.

Third party 130 may be a company, an individual, or a device, and may include a financial service provider, financial service provider device, merchant, merchant device, person standing next to ATM 110, law enforcement entity, law enforcement device, etc. Third party 130 may be associated with, be responsible for, own, or lease ATM 110. In addition, third party 130 may be configured to perform one or more operations consistent with disclosed embodiments.

Database 140 may include one or more memory devices that store information. By way of example, database 140 may include Oracle™ databases, Sybase™ databases, or other relational databases or non-relational databases, such as Hadoop sequence files, HBase™, or Cassandra™. The databases or other files may include, for example, data and information related to the source and destination of a network request, the data contained in the request, etc. Systems and methods of disclosed embodiments, however, are not limited to separate databases. Database 140 may include computing components (e.g., database management system, database server, etc.) configured to acquire and process requests for data stored in memory devices of database 140 and to provide data from database 140.

Server cluster 150 may be located in the same data center or different physical locations. Multiple server clusters 150 may be formed as a grid to share resources and workloads. Each server cluster 150 may include a plurality of linked nodes operating collaboratively to run various applications, software modules, analytical modules, rule engines, etc. Each node may be implemented using a variety of different equipment, such as a supercomputer, personal computer, server, mainframe, mobile device, or the like. In some embodiments, the number of servers and/or server cluster 150 may be expanded or reduced based on workload. In some embodiments, one or more components of system environment 100 (including one or more server clusters 150) may be placed behind a load balancer to support high availability and ensure real-time (or near real-time) processing of optimal decision predictions.

Cloud service 160 may include a physical and/or virtual storage system associated with cloud storage for storing data and providing access to data via a public network such as the Internet. Cloud service 160 may include cloud services such as those offered by, for example, Amazon®, Apple®, Cisco®, Citrix®, IBM®, Joyent®, Google®, Microsoft®, Rackspace®, Salesforce.com®, and Verizon®/Terremark®, or other types of cloud services accessible via WAN 120. In some embodiments, cloud service 160 comprises multiple computer systems spanning multiple locations and having multiple databases or multiple geographic locations associated with a single or multiple cloud storage service(s). As used herein, cloud service 160 refers to physical and virtual infrastructure associated with a single cloud storage service and may manage and/or store data associated with managing tip recommendations.

Figure 2B:
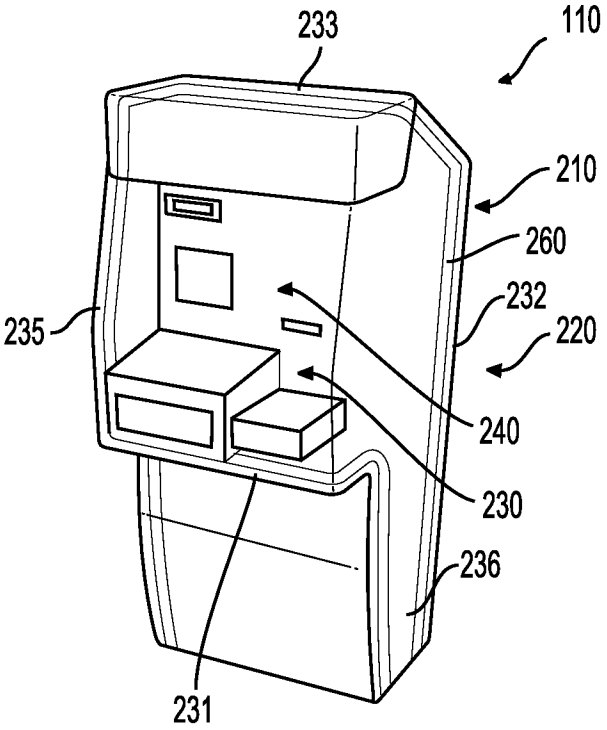
FIG. 2B is a schematic diagram of an interior view of an exemplary ATM consistent with disclosed embodiments.
Figure 2A:
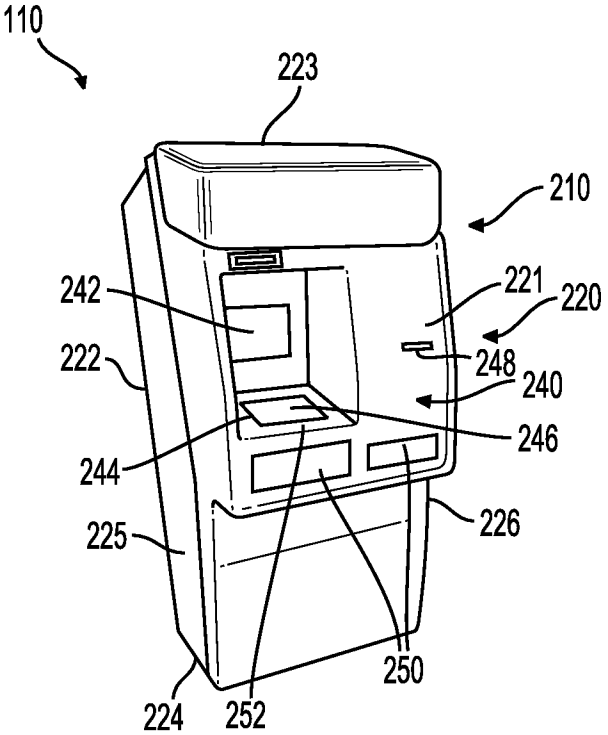
FIG. 2A is a schematic diagram of an exterior view of an exemplary automated teller machine (ATM) consistent with disclosed embodiments.

FIGS. 2A and 2B show exterior and interior views of ATM 110, with an electronic tattletale consistent with disclosed embodiments. ATM 110 may include a housing 210 that may encase valuables, such as currency, checks, deposit slips, etc., and/or electronic components, such as processors, memory devices, circuits, etc. Housing 210 may be made of various materials, including plastics, metals, polymers, woods, ceramics, concretes, paper, glass, etc. In some embodiments, housing 210 may have a different shape than the one shown in FIGS. 2A and 2B.

Housing 210 may include exterior housing surface 220 and interior housing surface 230. Exterior housing surface 220 may include one or more surfaces. For example, exterior housing surface 220 may include a front surface 221, back surface 222, top surface 223, bottom surface 224, left surface 225, and right surface 226. Interior housing surface 230 may also include one or more surfaces. For example, interior housing surface 230 may include a front surface 231, back surface 232, top surface 233, bottom surface 234, left surface 235, and right surface 236. The number of surfaces of exterior housing surface 220 and/or interior housing surface 230 is not limited by the present disclosure.

Exterior housing surface 220 may be made of the same material as interior housing surface 230. In some embodiments, exterior housing surface 220 may be made of a different material than interior housing surface 230. In some embodiments, exterior housing surface 220 and/or interior housing surface 230 may have one or more additional materials connected to it.

In some embodiments, housing 210 may include fascia 240. In some embodiments, fascia 240 may be connected to any surface of exterior housing surface 220 and/or interior housing surface 230. As depicted, for illustrative purposes only, fascia 240 is connected to front surface 221 of exterior housing surface 220. Fascia 240 may also be connected to multiple surfaces of exterior housing surface 220 and/or interior housing surface 230. Fascia 240 may be made of a different material than exterior housing surface 220 and/or interior housing surface 230. For example, fascia 240 may be made of plastic while exterior housing surface 220 and/or interior housing surface 230 may be made of sheet metal.

Fascia 240 may include components, such as one or more displays 242, key panels 244, function keys 246, card readers 248, slots 250, and/or writing shelves 252. The components of fascia 240 are only illustrative. Other components may be included in ATM 110. In some embodiments, components, such as those shown in FIG. 2, may be replaced with other components or deleted from ATM 110.

Display 242 may include a Thin Film Transistor Liquid Crystal Display (LCD), In-Place Switching LCD, Resistive Touchscreen LCD, Capacitive Touchscreen LCD, an Organic Light Emitted Diode (OLED) Display, an Active-Matrix Organic Light-Emitting Diode (AMOLED) Display, a Super AMOLED, a Retina Display, a Haptic or Tactile touchscreen display, or any other display. Display 242 may be any known type of display device that presents information to a user operating ATM 110. Display 242 may be a touchscreen display, which allows the user to input instructions to display 242. Other components, such as key panels 224, function keys 246, card readers 248, and/or slots 250 may allow the user to input instructions to display 242.

Card reader 248 may allow a user to, in some embodiments, insert a transaction card into ATM 110. The transaction card may be associated with a financial service provider. Card reader 248 may allow ATM 110 to acquire and/or collect transaction information from the transaction card. In some embodiments, card reader 248 may allow a user to tap a transaction card or mobile device in front of card reader 248 to allow ATM 110 to acquire and/or collect transaction information from the transaction card via technologies, such as near-field communication (NFC) technology, Bluetooth™ technology, and/or radio-frequency identified technology, and/or wireless technology. Card reader 248 may also be connected with a mobile application that allows the user to transfer transaction card information to card reader 248 and/or ATM 110 with or without inserting the transaction card.

Slots 250 may include one or more card slots (which may be connected to card reader 248), receipt slots, deposit slots, mini account statement slots, cash slots, etc. Slots 250 may allow a user of ATM 110 to insert or receive one or more receipts, deposits, withdrawals, mini account statements, cash, checks, money orders, etc.

Interior housing surface 230 may include an electronic tattletale 260. One or more components of tattletale 260, as discussed in FIG. 3, may be connected to interior housing surface 230 and other parts may be enclosed in interior housing surface 230 or outside of exterior housing surface 220. In some embodiments, substantially all components of tattletale 260 may be connected to and/or enclosed in interior housing surface 230.

Figure 3:
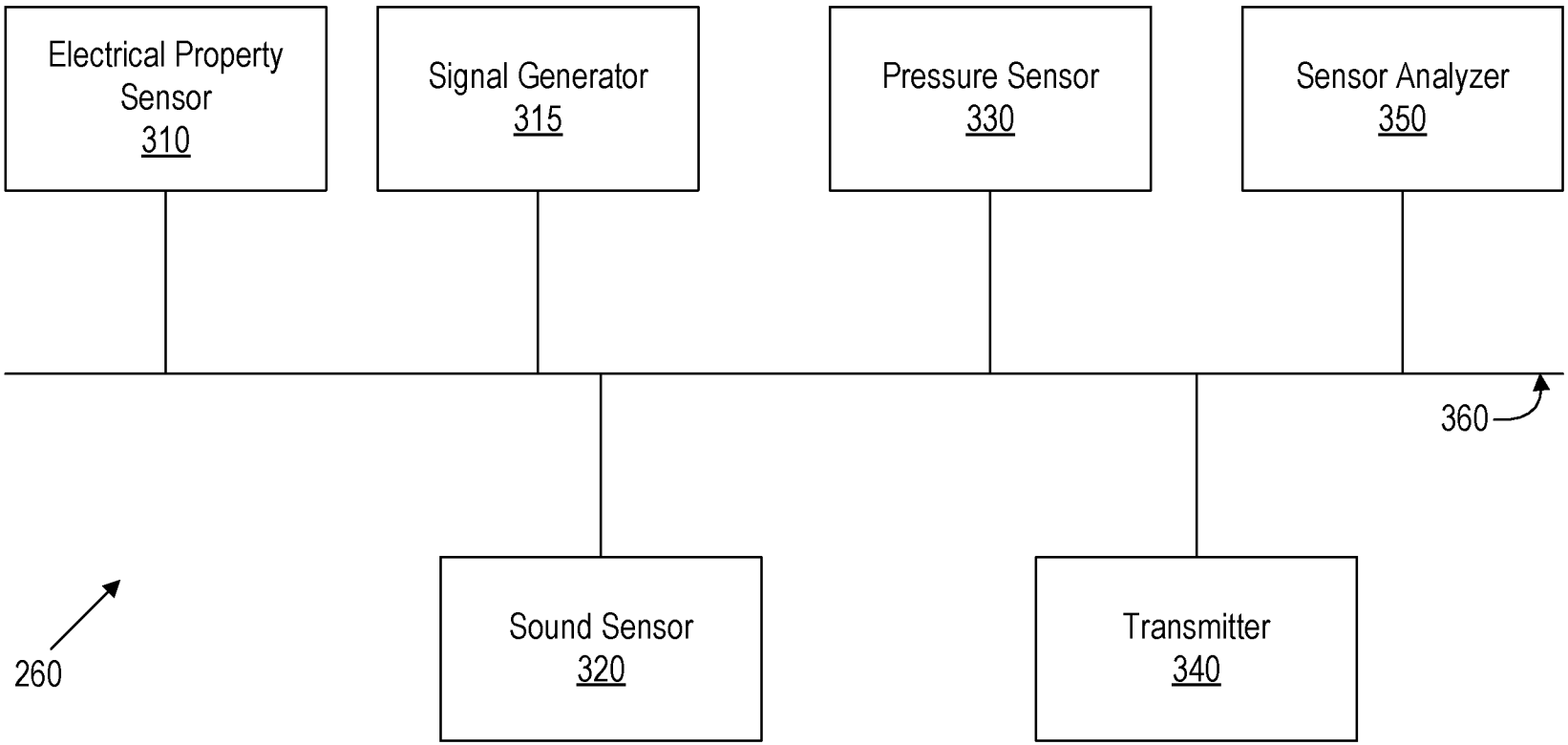
FIG. 3 is a block diagram of an exemplary electronic tattletale consistent with disclosed embodiments.

FIG. 3 is a block diagram illustrating a tattletale 260 (e.g., "a detection circuit") consistent with disclosed embodiments. Tattletale 260 may include components, such as an electrical property sensor 310, a signal generator 315, a sound sensor 320, a pressure sensor 330, a transmitter 340, and/or a sensor analyzer 350. In some embodiments, one or more components of tattletale 260 may be interconnected via a bus 360 to communicate bidirectionally with each other. One or more components of tattletale 260 may also be connected wirelessly via one or more wireless receivers (not shown) to communicate bidirectionally with each other.

Figure 4:
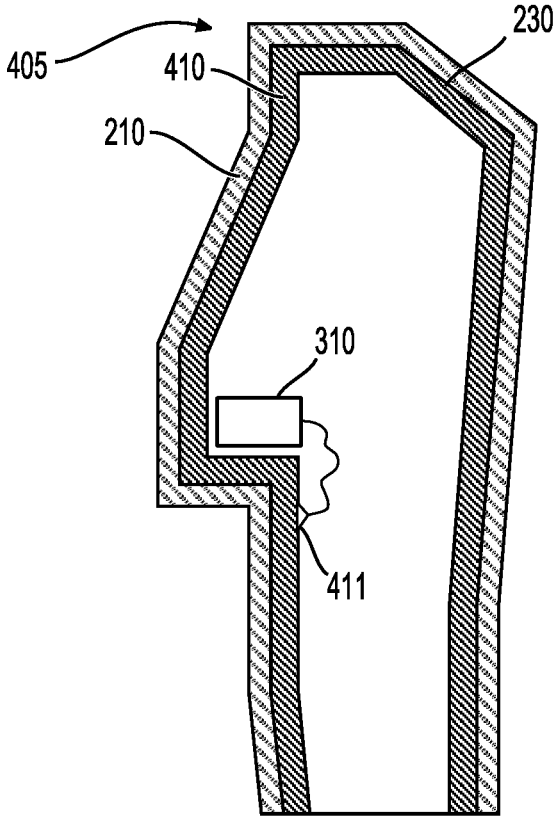
FIG. 4 is a cross-sectional view of the ATM of FIGS. 2A and 2B consistent with disclosed embodiments.

Electrical property sensor 310 may be coupled to hardware components, such as resistors, transistors, capacitors, piezoelectric transducers, inductors, semiconductors, sensors, etc., and/or software programs. Turning to FIG. 4, electrical component 405 may be connected to electrical property sensor 310 (not shown). Electrical component 405 may comprise substance 410 and/or interior housing surface 230 of housing 210. For example, electrical component 405 may be a capacitor that is formed when substance 410 is connected to interior housing surface 230 or electrical component 405 may be a capacitor that is formed by substance 410 itself. In other embodiments, electrical component 405 may be a piezoelectric element formed by applying substance 410 to interior housing surface 230. Electrical property sensor 310 may be coupled to electrical component 405. For example, electrical property sensor 310 may be coupled to interior housing surface 230 via substance 410, that is, electrical property sensor 310 may be connected to substance 410 and substance 410 may be connected to interior housing surface 230. In some embodiments, electrical property sensor 310 may be connected to substance 410 by at least one electrode 411, as shown in FIG. 4. Electrode 411 may be any device configured to provide an electrical contact with substance 410 for inducing and/or receiving one or more signals through the substance. In some embodiments, electrode 411 may be adhered to substance 410 by a conductive adhesive or by other suitable means. Electrical property sensor 310 and electrode 411 are shown in FIG. 4 by way of example only, and it is understood that various other configurations may be used.

Substance 410 may be connected to the entirety of interior housing surface 230 (which includes all surfaces of interior housing surface 230), the entirety of one more surfaces of interior housing surface 230, a part of one or more of surfaces of interior housing surface 230, a part of interior housing surface 230, etc. In some embodiments, substance 410 may also be connected to one or more internal components of ATM 110. After being connected to interior housing surface 230, the total thickness of substance 410 may be 5 mm or less. In some embodiments, substance 410 may be formed of one or more different materials than interior housing surface 230 to form electronic component 405. For example, substance 410 may be a dielectric (such as a polymer or ceramic material) while interior housing surface 230 may be a conductor (such as a metal) or substance 410 may be a conductor while interior housing surface 230 may be a dielectric.

In some embodiments, electrical component 405 may be configured to generate a response signal. For example, substance 410 may comprise a piezoelectric element (e.g., a piezoelectric transducer). Substance 410 may be configured such that when an electric current is applied to substance 410, vibrations are produced. Similarly, when pressure or vibrations are applied to substance 410, substance 410 may emit an electrical signal. Accordingly, substance 410 may be formed of a substance with piezoelectric properties, such as a piezoelectric ceramic, a naturally occurring crystal (e.g., quartz, berlinite, Rochelle salt, topaz, etc.), a synthetic crystal (langasite, etc.), a synthetic ceramic, or any other material with piezoelectric properties. In some instances, substance 410 may be a bimorph material.

Substance 410, alone or in combination with interior housing surface 230, may have non-zero electrical properties, such as a charge, resistance, capacitance, conductance, impedance, etc. In some embodiments, as described above, substance 410 may be electrical component 405 (e.g., a capacitor, a piezoelectric transducer, resistor, etc.). However, in some embodiments, substance 410, by being connected with interior housing surface 230, may form an electrical component 405; thus, it is to be understood that the properties with respect to the properties of substance 410 and/or interior housing surface 230 below may also apply to properties of interior housing surface 230 in combination with substance 410.

Substance 410, alone or in combination with interior housing surface 230, (e.g., electronic component 405) may comprise a multi-layered ceramic capacitor, a ceramic capacitor disc, a ceramic capacitor tubular, a plastic film capacitor, a paper capacitor, a mica capacitor, etc. Substance 410 may be sprayed and/or dispersed onto interior housing surface 230 to form a coating. For example, substance 410 may be a multi-layered ceramic capacitor that is sprayed and/or dispersed onto interior housing surface 230 that is made of sheet metal to form electronic component 405. In other embodiments, substance 410 may be a piezoelectric material, as discussed above. Accordingly, substance 410 may comprise a plurality of piezoelectric crystals (e.g. quartz crystals, etc.). In order to facilitate application, substance 410 may further comprise a conductive base substance, such as a resin or epoxy that may be coated or sprayed onto interior housing surface 230. For example, substance 410 may comprise an epoxy or resin (e.g., urethane, urea-formaldehyde, etc.) with quartz crystals (e.g., flakes) suspended or otherwise included in the base substance. In some embodiments, the base substance may further include additives to increase the conductivity of substance 410. Substance 410, in some embodiments, may be a molded insert. In some embodiments, the molded insert may be formed using standard composite forming techniques. The molded insert may conform to the fascia 240 of ATM 110. In some embodiments, the thickness of substance 410 may be 5 mm or less.

Turning back to FIG. 3, electrical property sensor 310 may detect a change in an electrical property of electrical component 405. As described above, electrical component 405 may be a hardware component that is formed when substance 410 is connected to interior housing surface 230 or electrical component 405 may be a hardware component that is formed by substance 410 itself. Electrical property sensor 310, alone or in combination with sensor analyzer 350, may detect the intrusion based on a change in an electrical property of electrical component 405.

In some embodiments, electrical property sensor 310, alone or in combination with sensor analyzer 350, may detect insertion of tools, such as drilling and/or cutting tools, into housing 210. In embodiments where electrical component 405 is a capacitor, these tools may change the capacitance of electrical component 405. In some embodiments, these tools may affect a change in capacitance of electrical component 405 as small as 1.0 picofarad, which electrical property sensor 310, alone or in combination with sensor analyzer 350, may detect.

In some embodiments, electrical property sensor 310 may detect an intrusion based on a signal generated by electrical component 405. For example, as described above, electrical component 405 may comprise a piezoelectric element. In a passive mode, electrical property sensor 310 may be configured to receive signals generated by electrical component 405 indicative of sounds and/or vibrations associated with ATM 110. Similar to a microphone array or similar device, the piezoelectric element may convert vibrations into corresponding electrical signals. The sounds and/or vibrations may be indicative of one or more events occurring on, around, or within ATM 110. For example, the sounds and/or vibrations may indicate an attempted case intrusion into ATM 110 (e.g., indicating a drilling action, a cutting action, a jackhammering action, a jostling of ATM 110, movement outside of ATM 110, opening of a panel of ATM 110, an object contacting the exterior of ATM 110, or the like). Telltale 260 may be configured to detect an intrusion into ATM 110 based on the electrical signal generated by electrical component 405. For example, sensor analyzer 350 may be configured to receive the electrical signal generated by electrical component 405 and determine (e.g., using intrusion detection module 592, described below) that an intrusion has occurred.

In some embodiments, the sounds and/or vibrations detected using electrical component 405 may indicate an operation of one or more internal components of ATM 110. For example, an internal component (e.g., a check or cash deposit module, a cash dispensing module, a cash recirculator, a card reader module, etc.) may be associated with a particular vibration or audio signature during normal operation of ATM 110. The signature may correspond to unique vibrations produced by an actuator (e.g., a drive motor, a stepper motor, a solenoid, etc.) or other mechanical component (e.g., bearings, rollers, belts, switches, cams, gears, etc.) during operation of the internal component. In some embodiments, the signature may be based on the software used to operate the internal component. For example, during operation of the internal component, the software may define a particular pattern of operation of the actuators (e.g., speed of operation, timing of operation, sequence of operation, etc.). This pattern may be intentionally programmed to produce an identifiable signal, or may merely be a pattern necessary for operation of the internal component. In other embodiments, the signature may be indicative of the execution of the software itself. For example, a processor, memory device, and/or other computing components running the software may produce vibrations detectable using electrical component 405, which may define a unique signature associated with execution of the software. Any variations in this signature may indicate that the software has been modified or altered in some way, which may indicate an intrusion, as discussed further below.

Telltale 260 may be configured to detect an intrusion based on the vibration or audio signal. As an illustrative example, an operation of ATM 110, such as a cash withdrawal operation, may be associated with a predefined signature. The signature may be based on software associated with performing the cash withdrawal operation or one or more actuators associated with the cash withdrawal operation, as described above. If, during a subsequent cash withdrawal operation, a signature is detected that does not match a known predefined signature, this may indicate that the cash withdrawal is not authorized. For example, a signature associated with operation of the component may be compared with a known signature associated with operation of the component. Similarly, signatures associated with execution of the software may be compared with known or predefined signatures associated with the execution of the software code. Any variations from the known signatures may indicate that the cash withdrawal is unauthorized. For example, variation in the software signature may indicate that the cash withdrawal has been initiated by malicious software, such as software external to ATM 110 and/or software that has been modified or altered in some way by an intruder. In other embodiments, the intrusion may be detected based on the timing of the unique signature being detected. For example, if the cash withdrawal signature is detected while there is no corresponding transaction being performed through ATM 110, the signature may indicate an unauthorized cash withdrawal procedure. In some embodiments, the intrusion may be detected by comparing the detected signature to one or more signatures known to correspond to an intrusion event. For example, a noise or vibration may be detected that is associated with a drilling or other operation. Accordingly, sensor analyzer 350 may access one or more databases (e.g. database 140) storing intrusion event signatures associated with predefined intrusion events. It is to be understood that the detection methods provided above are merely examples, and one skilled in the art may employ various other means of detecting an intrusion using the signatures and/or vibrations indicated by electrical component 405.

Changes in the detected signatures may further be used to indicate other statuses of ATM 110. For example, rather than detecting an intrusion, the vibrations and/or sounds captured using electrical component 405 may indicate a health status of ATM 110 or a health of various internal components of ATM 110. For example, normal operation of ATM 110 or various internal components may be associated with a predefined normal operation signature. Similar to the signatures described above with respect to intrusion detection, the signature may be based on a software component (e.g., a program, code, etc.), one or more actuators (e.g., a drive motor, a stepper motor, a solenoid, etc.) or other mechanical components (e.g., bearings, rollers, belts, switches, cams, gears, fans, hard drives, etc.) associated with the internal component or ATM 110. Sensor analyzer 350 may be configured to detect, through the electrical signals generated by electrical component 405, one or more failure conditions associated with the internal components. For example, an internal component that is not functioning properly (e.g., due to a mechanical failure, a software glitch, etc.) may generate a failure condition signature that is different than the normal operation signature. Sensor analyzer 350 may be configured to detect the failure condition based on the failure condition signature.

In some embodiments, the failure condition signature may be used for diagnosis of a failure condition. This may be valuable for saving time associated with identifying a failure condition and may thus reduce the down time and/or maintenance time required for the ATM. For example, ATM 110 may be malfunctioning, but it may not be clear what the source of the malfunction is. The failure condition signal may be used to isolate and/or identify the failure. For example, the failure condition signal may indicate a particular software glitch, that a particular internal component is failing, that a particular actuator within an internal component has failed, a particular form of failure (e.g., motor is worn out, internal component is jammed, internal component is dirty, etc.), or the like. Each form of failure may be associated with a different failure condition signal that may be used for diagnosis purposes. In some embodiments, each failure condition signal may be associated with a predefined code or other failure indicator that may be output by sensor analyzer 350 and used to diagnose a failure during a maintenance operation. The failure indicator may also be transmitted to an external device or entity, such as third party 130.

In some embodiments, the failure condition signature may be associated with a future failure or malfunction of ATM 110. Accordingly, the failure condition signature may be used to predict an impending failure of one or more internal components. For example, the failure condition signal may be indicative of a particular stage in the lifecycle of the internal component. A trained detection system (e.g., sensor analyzer 350) may detect minute changes in the signature (e.g., vibrations associated with the operation of the internal component) that may be otherwise imperceptible, even during an inspection or maintenance operation. Sensor analyzer 350 may generate and/or transmit a warning or other indication of the predicted mechanical failure.

In addition to, or as an alternative to, the passive detection mode, tattletale 260 may also operate in an active detection mode. In the active detection mode, tattletale 260 may induce a signal through electronic component 405 and measure a response signal. Where electronic component 405 is a piezoelectric element, as described above, even slight physical changes (which may represent an intrusion) to the piezoelectric element or to ATM 110 may have a significant effect on the response signal generated by electrical component 405. Accordingly, the response signal may be used to compare to a predefined or expected response signal to identify an intrusion into ATM 110.

The input signal induced on the piezoelectric element may be any waveform for which there is an expected response from the piezoelectric element. For example, the input signal may be a predefined alternating current (AC) waveform (e.g., a sinusoidal wave, a triangular wave, a square wave, a sawtooth wave, a complex wave, etc.). The AC input signal may be induced on the piezoelectric element through one or more electrodes (e.g., electrode 411), causing vibration of the piezoelectric element. In order to generate the input signal, tattletale 260 may include at least one signal generator 315. Signal generator 315 may be any device capable of generating an AC input signal, such as a function generator, a waveform generator, a pulse generator or the like.

Electrical property sensor 310 may be configured to receive a response signal produced by electrical component 405 based on the input signal generated by signal generator 315. For example, where electronic component 405 is a piezoelectric element, the input signal generated by signal generator 315 may cause the piezoelectric element to vibrate at a certain frequency associated with the waveform used. The resonance frequency of the piezoelectric element may be measured by electrical property sensor 315. Because the piezoelectric element is unique to each individual ATM 110 (e.g., due to minute differences in applying substance 410), the resonance frequency may also be uniquely associated with electrical component 405 and/or ATM 110 (e.g., dependent on the unique shape, volume, composition, etc. of the piezoelectric element). In some embodiments, the frequency response may be measured based on an impedance value of the piezoelectric element. For example, the impedance of the piezoelectric element may be measured for a given input signal frequency. In some embodiments, the frequency of the input signal may be varied, and a minimum impedance frequency of the element may be determined, corresponding to a resonance frequency of the piezoelectric element. Accordingly, signal generator 315 and electrical property sensor 310 may be a single component and the frequency response may be measured based on impedance of the signal generator 315. Various other known methods may also be used for measuring a response of the piezoelectric element.

Sensor analyzer 350 may be configured to detect an intrusion based on the frequency response measured by electrical property sensor 310. Sensor analyzer 350 may compare the measured frequency response to a predefined or expected frequency response value, which may be a measured frequency response value obtained during a calibration operation. For example, the calibrated frequency response signal may be obtained by inducing a test input signal (which may be the same as the input signal used to identify intrusions) and measuring a frequency response value. The calibrated frequency response signal may be stored and used for detecting intrusions by sensor analyzer 350. For example, the calibrated frequency response value may be stored in a memory 580 of sensor analyzer 350, described in further detail below with respect to FIG. 5. Because even slight variations to the piezoelectric element will affect the impedance of the element at a given frequency, or the resonance frequency of the element, any deviations from the calibrated frequency response value may indicate an intrusion. In embodiments where the piezoelectric element is applied as a coating to the entirety (or substantially the entirety) of interior surface 230, any intrusion to the ATM 110 (e.g., an incision, a piercing, a drill hole, a penetration, a dent, etc.) will be detectable through the frequency response signal. Because the frequency response signal generated by the piezoelectric element may be sensitive to slight changes (e.g., movement or modification of internal components of ATM 110, temperature, etc.), regular calibration of the expected frequency response signal may be required, for example, at set time intervals, after each maintenance operation, after each software update, etc.

In some embodiments, tattletale 260 may include other sensors (including sensors not depicted in FIG. 3). As shown in FIG. 3, tattletale 260 may include sound sensor 320. Sound sensor 320, alone or in combination with sensor analyzer 350, may detect changes in sound. In some embodiments, sound sensor 320 may detect quiet sounds, such as sounds generated by a low-powered drilling or cutting tool. Sound sensor 320, alone or in combination with sensor analyzer 350, may also detect other sounds, such as those from an object tapping, being placed on, and/or being attached to ATM 110. In some embodiments, sound sensor 320 may detect vibrations or the movement of ATM 110, which may also detect sound.

Sound sensor 320, alone or in combination with sensor analyzer 350, may use surface acoustic wave detection techniques to detect the change in sound. For example, sound sensor 320 may include one or more surface acoustic wave sensors. The one or more surface acoustic wave sensors may rely on the modulation of surface acoustic waves to sense a physical change, such as a change in temperature, mass, vibration, etc., of ATM 110. Sound sensor 320, alone or in combination with sensor analyzer 350, may detect the intrusion based on one or more signals generated by the surface acoustic wave sensor.

In some embodiments, sound sensor 320 may be coupled to electrical property sensor 310. Sound sensor 320 may detect an intrusion of housing 210 alone, in combination with sensor analyzer 350, and/or in combination with another sensor in FIG. 3 (e.g., electrical property sensor 310, pressure sensor 330, etc.). Sound sensor 320, alone or in combination with sensor analyzer 350, may verify the intrusion based on determining that the change in sound exceeds a predetermined threshold. In some embodiments, sound sensor 320 and/or electrical property sensor 310 may utilize transmitter 340 to transmit an intrusion alert signal upon detection or the verification that an intrusion has occurred.

In some embodiments, tattletale 260 may include, additionally or alternatively, pressure sensor 330. Pressure sensor 330, alone or in combination with sensor analyzer 350, may detect changes in pressure. Pressure sensor 330 may be coupled to a pressurized bladder (not pictured) connected to interior housing surface 230. Pressure sensor 330, alone or in combination with sensor analyzer 350, may detect a change in the pressure of the pressurized bladder. For example, when a drilling or cutting tool shifts or pierces the pressurized bladder, the internal air pressure of the pressurized bladder may change and pressure sensor 330, alone or in combination with sensor analyzer 350, may detect that change. In some embodiments, pressure sensor 330 may include one or more piezoelectric transducers and/or pressure sensors, to detect a change in the pressure of the pressurized bladder and/or housing 210.

Pressure sensor 330 may be coupled to electrical property sensor 310. Pressure sensor 330, alone or in combination with sensor analyzer 350, may detect an intrusion of housing 210 alone. On the other hand, pressure sensor 330, alone or in combination with sensor analyzer 350, may detect an intrusion of housing 210, along with other sensors in FIG. 3. In some embodiments, pressure sensor 330, alone or in combination with sensor analyzer 350, may verify an intrusion detected by other sensors in FIG. 3 (e.g., electrical property sensor 310, sound sensor 320, etc.). Pressure sensor 330, alone or in combination with sensor analyzer 350, may verify the intrusion based on determining that the change in sound exceeds a predetermined threshold. In some embodiments, pressure sensor 330 and/or electrical property sensor 310, alone or in combination with sensor analyzer 350, may utilize transmitter 340 to transmit an intrusion alert signal upon detection or the verification that an intrusion has occurred.

Although not shown, other sensors, alone or in combination with sensor analyzer 350, may be used in tattletale 260 to detect or verify an intrusion into housing 210. The other sensors, alone or in combination with sensor analyzer 350, may be used to detect changes, such as changes in temperature, movement, location, etc., of all or parts of housing 210. In addition, the other sensors may utilize transmitter 340, alone or in combination with sensor analyzer 350, to transmit an intrusion alert signal upon detection or the verification that an intrusion has occurred.

Tattletale 260 may include, additionally or alternatively, transmitter 340. Transmitter 340 may transmit an alert, such as a sound, light, email, alert, message, telephone call, radio signal, etc., to third party 130. Third party 130 may or may not be associated with ATM 110. Transmitter 340, alone or in combination with sensor analyzer 350, may transmit an alert via hardware or software. Transmitter 340 may also be located on exterior housing surface 220. In some embodiments, transmitter 340 may transmit messages via one or more components of fascia, such as display 242 or slot 250. Transmitter 340 may transmit alerts using technologies, such as near-field communication (NFC) technology, Bluetooth™ technology, radio-frequency identified technology, wireless technology, hardware technology (e.g., infrared lights, microphones, speakers, etc.).

Figure 5:
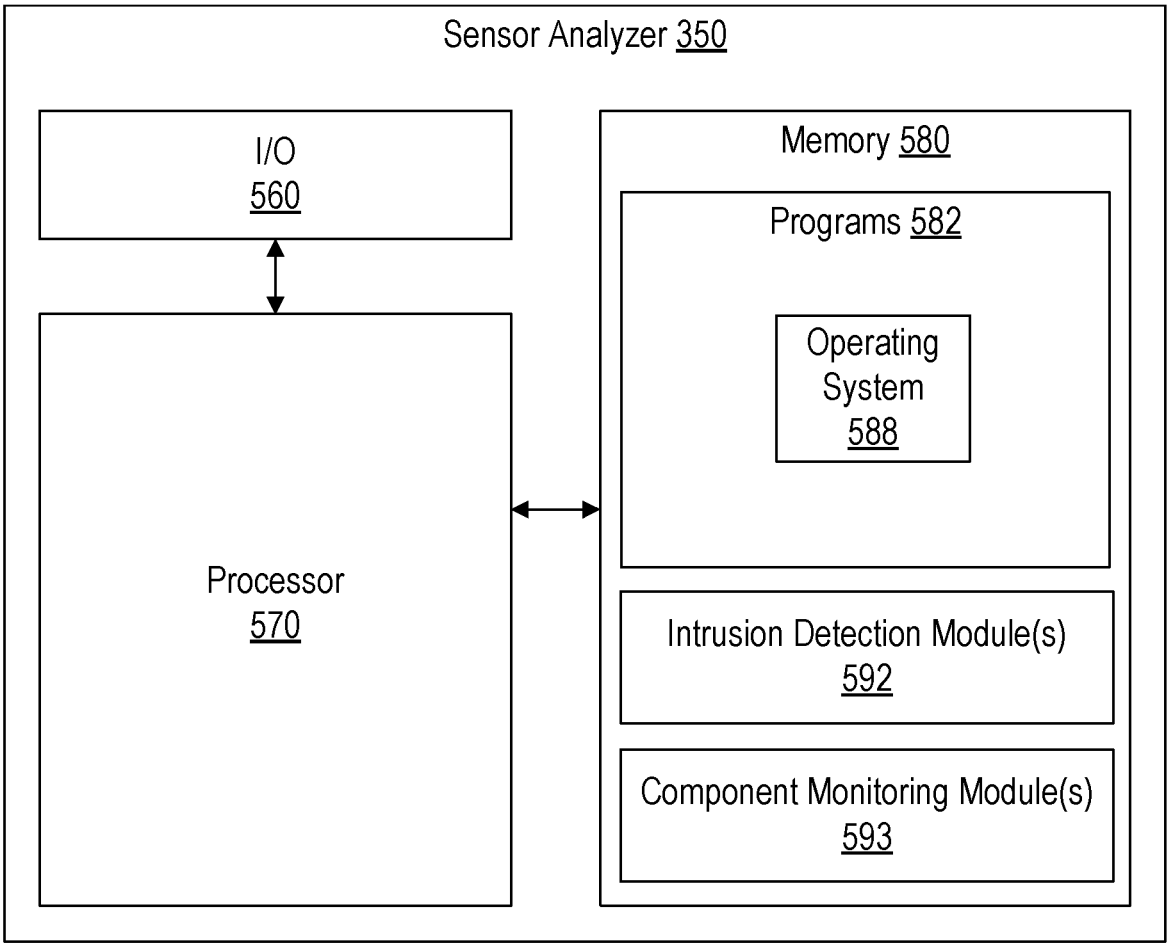
FIG. 5 is a block diagram of an exemplary sensor analyzer consistent with disclosed embodiments.

Tattletale 260 may, additionally or alternatively, include sensor analyzer 350. FIG. 5 is a block diagram of an exemplary sensor analyzer consistent with disclosed embodiments. Sensor analyzer 350 may detect an intrusion into housing 210, alone or in combination, with other components of tattletale 260. As shown in FIG. 5, sensor analyzer 350 may include one or more input/output ("I/O") devices 560, processors 570, and memory devices 580 storing data and programs 582 (including, for example, operating system 588, instruction detection module 592, and component monitoring module 593). The logic or programs of sensor analyzer 350 can be implemented in hardware, software, and/or a combination thereof.

Sensor analyzer 350 may also include one or more I/O devices 560 that may comprise one or more interfaces for receiving input (e.g., signals from either or both of sound sensor 320 and pressure sensor 330) or output to either or both of sound sensor 320 and pressure sensor 330 in FIG. 3. Processor 570 may be one or more known or custom processing devices designed to perform functions of the disclosed methods, such as a single core or multiple core processors capable of executing parallel processes simultaneously. For example, processor 570 may be configured with virtual processing technologies. In certain embodiments, processor 570 may use logical processors to execute and control multiple processes simultaneously. Processor 570 may implement virtual machine technologies, including a Java® Virtual Machine, or other known technologies to provide the ability to execute, control, run, manipulate, store, etc., multiple software processes, applications, programs, etc. In another embodiment, processor 570 may include a multiple-core processor arrangement (e.g., dual core, quad core, etc.) configured to provide parallel processing functionalities to allow sensor analyzer 350 to execute multiple processes simultaneously. One of ordinary skill in the art would understand that other types of processor arrangements could be implemented that provide for the capabilities disclosed herein.

Sensor analyzer 350 may include memory device 580 configured to store information used by processor 370 (or other components) to perform certain functions related to the disclosed embodiments. In one example, memory device 580 may comprise one or more storage devices that store instructions to enable processor 570 to execute one or more applications, such as server applications, network communication processes, and any other type of application or software known to be available on computer systems. Alternatively or additionally, the instructions, application programs, etc., may be stored in an internal database or external storage (not shown) in direct communication with sensor analyzer 350, such as one or more database or memory accessible over WAN 120. The internal database and external storage may be a volatile or non-volatile, magnetic, semiconductor, tape, optical, removable, non-removable, or another type of storage device or tangible (e.g., non-transitory) computer-readable medium.

Sensor analyzer 350 may also be communicatively connected to one or more remote memory devices (e.g., remote databases (not shown)) through WAN 120 or a different network. The remote memory devices may be configured to store information (e.g., structured, semi-structured, and/or unstructured data) and may be accessed and/or managed by sensor analyzer 350. By way of example, the remote memory devices may be document management systems, Microsoft® SQL database, SharePoint® databases, Oracle® databases, Sybase™ databases, or other relational databases. Systems and methods consistent with disclosed embodiments, however, are not limited to separate databases or even to the use of a database.

In certain embodiments, sensor analyzer 350 may include memory device 580 that includes instructions that, when executed by processor 570, perform one or more processes consistent with the functionalities disclosed herein. Methods, systems, and articles of manufacture consistent with disclosed embodiments are not limited to separate programs or computers configured to perform dedicated tasks. For example, sensor analyzer 350 may include memory device 580 that stores instructions constituting one or more programs 582, intrusion detection module(s) 592, and/or component monitoring module(s) 593 to perform one or more functions of the disclosed embodiments. Moreover, processor 370 may execute one or more programs located remotely on system environment 100. For example, sensor analyzer 350 may access one or more remote programs, that, when executed, perform functions related to disclosed embodiments.

Memory device 580 may include one or more memory devices that store data and instructions used to perform one or more features of the disclosed embodiments. For example, memory device 580 may represent a tangible and non-transitory computer-readable medium having stored therein computer programs, sets of instructions, code, or data to be executed by processor 570. Memory device 580 may include, for example, a removable memory chip (e.g., EPROM, RAM, ROM, DRAM, EEPROM, flash memory devices, or other volatile or non-volatile memory devices) or other removable storage units that allow instructions and data to be accessed by processor 570.

Memory device 580 may also include any combination of one or more relational and/or non-relational databases controlled by memory controller devices (e.g., server(s), etc.) or software, such as document management systems, Microsoft® SQL database, SharePoint® databases, Oracle® databases, Sybase™ databases, other relational databases, or non-relational databases, such as key-value stores or NoSQL™ databases, such as Apache HBase™. In some embodiments, memory device 580 may comprise associative array architecture, such as a key-value storage, for storing and rapidly retrieving large amounts of information.

Programs 582 stored in memory device 580 and executed by processor(s) 570 may include one or more operating system 588. Programs 582 may also include one or more machine learning, trending, and/or pattern recognition applications (not shown) to detect an intrusion into housing 210. For example, one or more machine learning, trending, and/or pattern recognition applications may provide, modify, or suggest input variables associated with one or more other programs 582.

Figure 6:
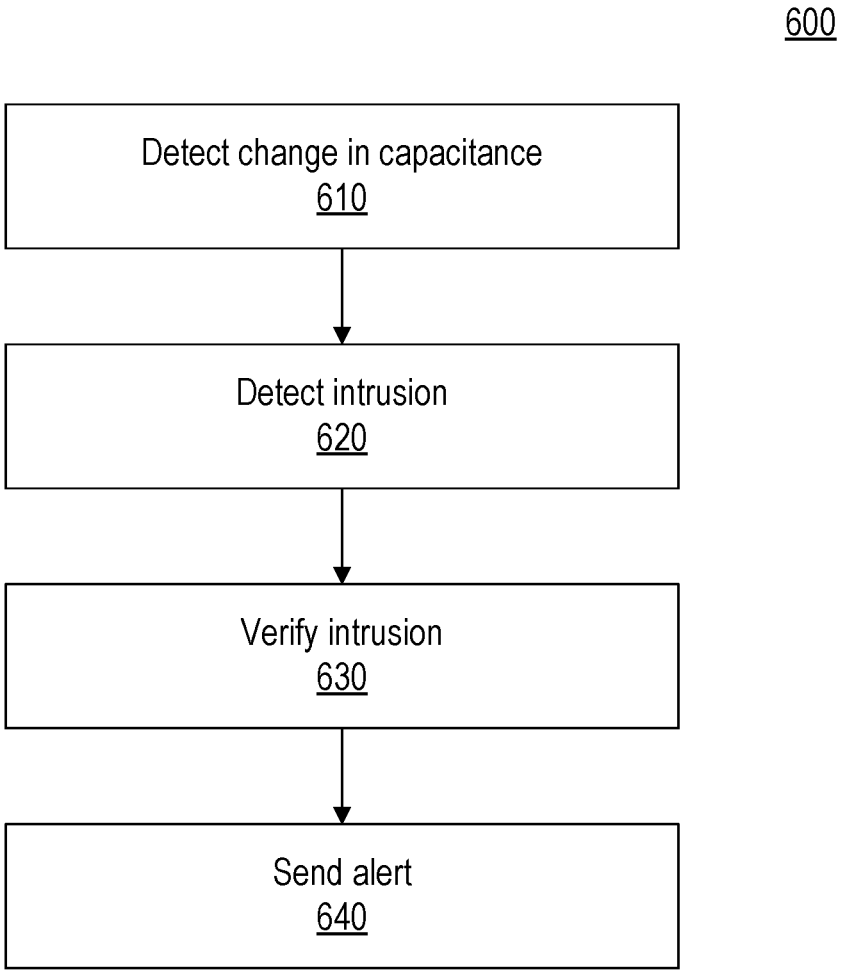
FIG. 6 is a flowchart of an exemplary process for detecting an intrusion into a housing based on a change in capacitance consistent with disclosed embodiments.

FIG. 6 is a flowchart illustrating an exemplary process 600 for detecting an intrusion into housing 210 based on a change in capacitance consistent with disclosed embodiments. Sensor analyzer 350, via intrusion detection module (s) 592, may implement the steps, as illustrated in the flowchart. However, the steps illustrated in the flowchart are only exemplary. One or more steps may be added or deleted to detect an intrusion into housing 210. The steps of FIG. 6 may be implemented via hardware via one or more of the sensors (e.g., electrical property sensor 310, sound sensor 320, pressure sensor 330, etc.), as described above with respect to FIG. 3.

At step 610, intrusion detection module 592 may detect a change in the capacitance of, for example, electrical component 405. For example, intrusion detection module 592 may detect the change in capacitance by obtaining one or more capacitance values of electrical component 405 (e.g., via electrical property sensor 310). Intrusion detection module 592 may obtain the capacitance values by acquiring, receiving, and/or reading the capacitance of electrical component 405. In some embodiments, intrusion detection module 592 may obtain capacitance values by calculating the capacitance of electrical component 405 from other electrical properties and/or components of electrical property sensor 310.

At step 620, intrusion detection module 592 may detect an intrusion based on the change in capacitance. Intrusion detection module 592 may detect the intrusion based on determining that a difference between capacitance values exceeds a predetermined threshold. Intrusion detection module 592 may also detect the intrusion based on determining that an absolute value of a difference between the capacitance values exceeds a predetermined threshold. The predetermined threshold value may indicate the smallest amount of change in capacitance before an intrusion can be determined.

If intrusion detection module 592 detects an intrusion based on the change in capacitance, intrusion detection module 592 may verify that an intrusion has occurred (at step 630). In some embodiments, intrusion detection module 592 may detect a change in sound based on detecting a change in a measurement made by an surface acoustic wave sensor via sound analyzer 320 (using techniques similar to step 610) and verify the intrusion based on determining that the change in sound exceeds a predetermined threshold (using techniques similar to step 620). In certain embodiments, intrusion detection module 592 may detect a change in pressure based on a change in a measure made by one or more piezoelectric transducers and/or pressurized bladders via pressure analyzer 330 (using techniques similar to step 610) and verify the intrusion based on determining that the change in pressure exceeds a predetermined threshold (using techniques similar to step 620).

At step 640, intrusion detection module 592 may send an alert to third party 130 if intrusion detection module 592 detects an intrusion based on the change in capacitance and/or verifies that an intrusion has occurred. Intrusion detection module 592 may or may not send the alert via transmitter 340. In some embodiments, intrusion detection module 592 may send the alert to third party 130 who is associated with law enforcement. In some embodiments, intrusion detection module 592 may send the alert to third party 130 who is associated with ATM 110. In certain embodiments, intrusion detection module 592 may send more than one alert. The alert may be silent and not visible to a potential intruder.

Figure 7:
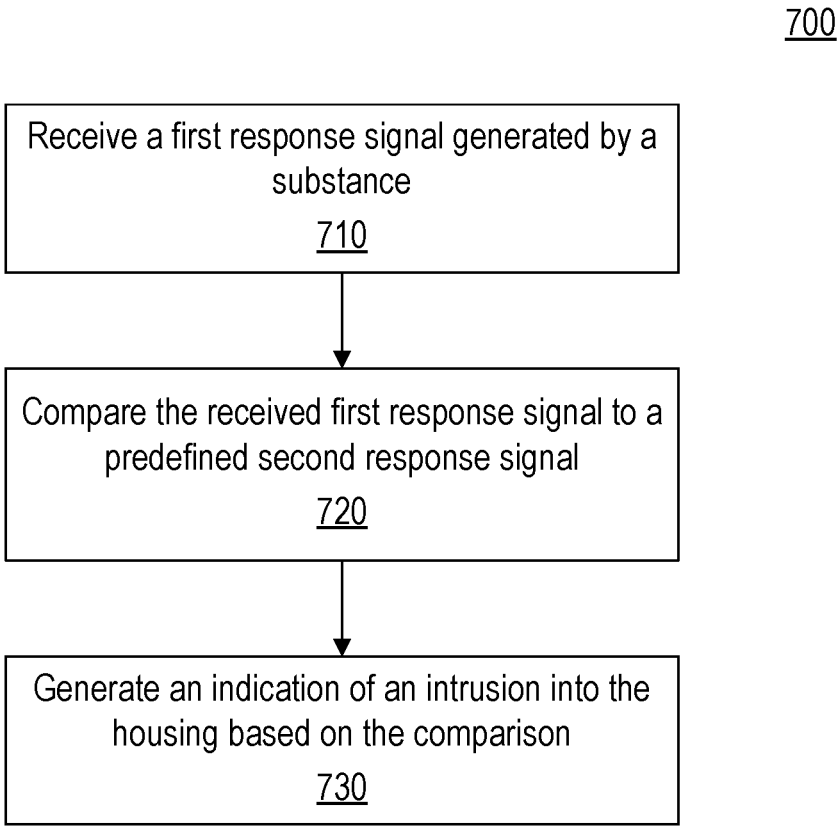
FIG. 7 is a flowchart of an exemplary process 700 for detecting an intrusion into a housing using a piezoelectric element.

FIG. 7 is a flowchart of an exemplary process 700 for detecting an intrusion into housing 210 using a piezoelectric element. Similar to process 600, sensor analyzer 350, via intrusion detection module(s) 592, may implement the steps, as illustrated in the FIG. 7. However, the steps illustrated in the flowchart are only exemplary. One or more steps may be added or deleted to detect an intrusion into housing 210 and/or ATM 110. The steps of FIG. 7 may be implemented via hardware via one or more of the components (e.g., electrical property sensor 310, signal generator 315, sound sensor 320, pressure sensor 330, etc.), as described above with respect to FIG. 3.

At step 710, process 700 may comprise receiving a first response signal generated by a substance. For example, intrusion detection module 592 may receive a first response signal generated by electrical component 405 through electrical property sensor 310. As described above, electrical component 405 may comprise a piezoelectric element, such as a piezoelectric transducer, that may be adhered to interior surface 230 of ATM 110. In some embodiments, the substance (e.g., electrical component 405) may comprise a coating applied to the interior surface, for example, by spraying, rolling, brushing, or other means. In some embodiments, the coating may be adhered to an entirety of the interior surface, or substantially the entirety of the interior surface (e.g., at least 99%, 95%, 90% or a lower percentage that is nevertheless still substantially the entirety of the interior surface, of the interior surface). In some embodiments, the substance may further be adhered to one or more internal components of ATM 110. The substance may also be adhered to the interior surface by various other means, for example, as a molded insert, an expanding foam, a flexible wrap, a tape, or the like.

The piezoelectric element may be formed of any material exhibiting piezoelectric properties sufficient for detection of an intrusion according to the disclosed embodiments. For example, the piezoelectric element may comprise at least one of a crystalline material, a ceramic material, a polymer, or any of the various materials discussed above. In some embodiments, the piezoelectric element may comprise a base material and a plurality of piezoelectric particles and/or flakes. For example, the base material may comprise an epoxy material, a resin material (e.g., polyurethane, urea-formaldehyde, etc.) or any other suitable base material. The particles or flakes may be formed of any of the piezoelectric materials described above (e.g., quartz flakes, ceramic particles, etc.). The base material may further be a conductive material to enhance the piezoelectric properties of the substance and thus may include one or more additives for increasing the conductivity of the base material.

In some embodiments, a detection circuit may be coupled to the substance, and may be configured to perform any of the steps described with respect to process 700. Accordingly, the detection circuit may be tattletale 260, or may comprise one or more components or elements of tattletale 260 described above. The detection circuit may comprise an electrode (e.g., electrode 411) coupled to the substance. In some embodiments, the electrode may be configured to provide an electrical contact with the substance for inducing and/or receiving one or more signals through the substance. The electrode may be adhered to the substance by a conductive adhesive or by other suitable means.

At step 720, process 700 may comprise comparing the received first response signal to a predefined second response signal. As discussed above, tattletale 260 may operate in an active detection mode or a passive detection mode. In the active detection mode, the detection circuit may further be configured to induce an input signal on the substance. As discussed above, the input signal may be generated by signal generator 315, and may comprise an AC waveform (e.g., a sinusoidal wave, a triangular wave, a square wave, a sawtooth wave, a complex wave, etc.). In the active detection mode, the response signal may be based on unique properties of the substance. For example, the response signal generated by the substance in response to the input signal may vary based on the shape, volume, composition, integrity, or other properties of the substance. Accordingly, the substance may comprise a material with properties such that when the material is subjected to a physical change, the received first response signal is based on the input signal and the physical change. As discussed in further detail above, the response signal may represent an impedance value, a resonance frequency or any other measurable value based on the input signal.

In the active detection mode, the second response signal may be based on an expected response to the input signal. For example, the expected response to the input signal may represent an expected impedance value associated with the frequency of the input signal, an expected resonance frequency of the substance, or a similar expected value. The expected response may be uniquely calibrated to the substance and/or the ATM. In some embodiments, the second response signal may comprise a signal determined by inducing a test signal on the substance and recording the test response signal, for example, as part of a calibration operation. The calibration operation may be performed periodically at set time intervals (e.g. hourly, daily, weekly, monthly, etc.), as part of a maintenance operation performed on the ATM, as part of a software update, as part of a transaction, etc.

In some embodiments, process 700 may be performed in a passive detection mode, as described above. The passive detection mode may use the substance as a piezoelectric sensor that converts sounds and/or vibrations into electrical signals comprising the first response signal. As described above, the first response signal may correspond to the operation of one or more internal components of the ATM, the running of a particular software program or code associated with the operation of the ATM, or the like. In some embodiments, the predefined second response signal may be a signature associated with the normal or expected operation of ATM 110.

In some embodiments, the second response signal may comprise at least one intrusion event signal associated with at least one predefined intrusion event. Predefined intrusion events may correspond to events that may indicate an intrusion into the ATM (e.g., a drilling action, a cutting action, a jackhammering action, a jostling the ATM, an unauthorized access to a panel of ATM 110, an unauthorized transaction, or the like). The intrusion event signals may be correlated with the predefined intrusion events. The intrusion event signals may be stored in a database (e.g., database 140), a local memory (e.g., memory 580) or any other storage location accessible by intrusion detection module 592. Intrusion detection module 592 may detect an intrusion by comparing the received first response signal to the stored intrusion event signals to determine a match.

In some embodiments, the intrusion event signals may comprise signals developed using a machine learning algorithm. For example, a model may be developed by providing a plurality of measured response signals associated with known intrusion events. The model may be developed using a logistic regression model, linear regression model, a lasso regression analysis, a random forest model, a K-Nearest Neighbor (KNN) model, a K-Means model, a decision tree, a cox proportional hazards regression model, a Naïve Bayes model, a Support Vector Machines (SVM) model, a gradient boosting algorithm, or any other suitable algorithm.

At step 730, process 700 may comprise generating an indication of an intrusion into the housing based on the comparison in step 720. For example, in an active mode, generating an indication of an intrusion into the housing may comprise determining that the received first response signal does not match an expected response to the input signal (e.g., the impedance or resonance frequency has changed by more than a predetermined threshold). This may indicate that the substance (and, accordingly, the housing) has been altered in some way. In the active mode, the response to an input signal may be measured periodically, for example, at predefined intervals (e.g., every second, every minute, every hour, every day, etc.), before or after performing a transaction, etc. In some embodiments, the response to an input signal may be measured based on inputs from one or more other sensors. For example, process 700 may be performed based on a sound detected by sound sensor 320, a change in pressure detected by pressure sensor 320, or any other sensor input. In a passive mode, generating the intrusion detection indication may comprise determining a match between the received first response signal and at least one intrusion event signal, and/or a predefined signature, as described above. For example, the first response signal may be associated with execution of at least one software code segment and the predefined second response signal may represent a normal or expected signature associated with execution of the at least one software code segment. The comparison of the received first response signal to a predefined second response signal may indicate that the software code segment has been modified.

In some embodiments, process 700 may further include performing at least one control action based on the generated indication of an intrusion into the housing. For example, process 700 may comprise transmitting an intrusion alert signal upon generation of the intrusion detection indication. The intrusion alert signal may be generated by intrusion detection module 592 and may be transmitted by a transmitter coupled to the detection circuit (e.g., transmitter 340). The intrusion alert signal may be transmitted through a network (e.g., network 120) to a third party (e.g., third party 130), such as a law enforcement entity, a security provider, a financial institution associated with the ATM, or the like. Various other control actions may also be performed, including halting or preventing a transaction, locking or shutting down one or more internal components of the ATM, locking or freezing an account associated with the ATM, generating an audible or visual alert, or any other suitable security measure.

As described above, in some embodiments the substance (e.g., electrical component 405) may be used to detect one or more failure conditions associated with ATM 110. Accordingly, rather than generating an indication of an intrusion into the housing, process 700 may include generating an indication of a failure condition of the ATM. In such embodiments, one or more steps of process 700 may be performed by component monitoring module 593. As described in greater detail above, the failure condition may be indicative of a software glitch, a mechanical failure, or the like. In some embodiments, the failure condition may represent a potential future failure (e.g., a component being worn, loose, dirty, in need of maintenance, etc.). Accordingly, the predefined second response signal may represent a signature associated with the healthy operation of ATM 110 (or the various internal components) and the failure condition may be detected based on a deviation of the received first response signal from the predefined second response signal. In other embodiments, the predefined second response signal may comprise a plurality of failure condition event signals associated with predefined failure conditions, similar to the intrusion event signals discussed above. Accordingly, component monitoring module 593 may access one or more databases storing the failure condition event signals (e.g., on database 140, memory 580, or any other storage location accessible to component monitoring module 593). In some embodiments, similar to the intrusion event signals, the failure condition event signals may be developed using an artificial intelligence or machine learning model. For example, a plurality of detected signatures associated with known failure conditions may be fed into a training algorithm to develop a model, which may then be used to correlate detected signals to predefined failure conditions.

Figure 8:
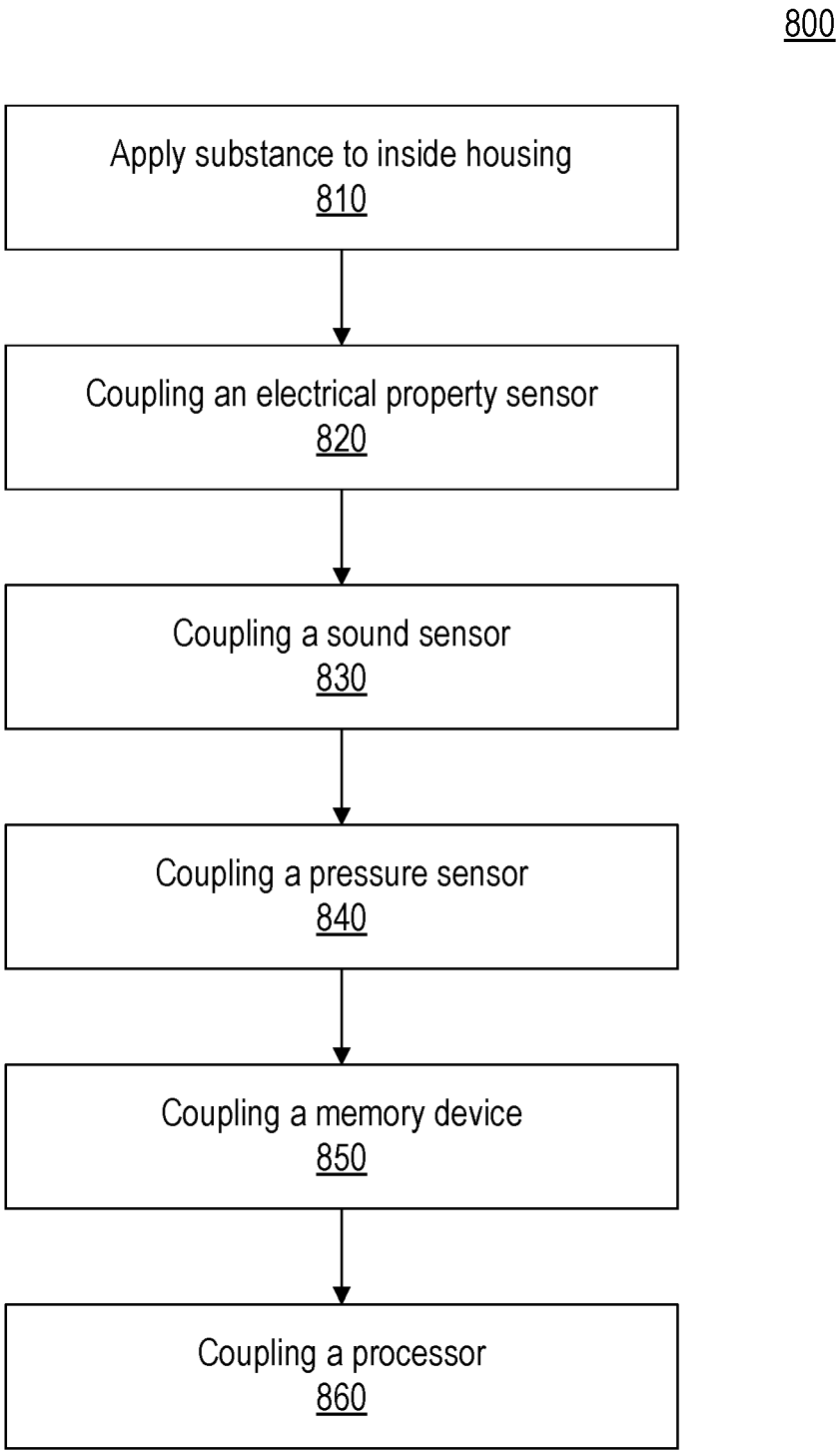
FIG. 8 is a flowchart of an exemplary process for manufacturing an ATM consistent with disclosed embodiments.

FIG. 8 is a flowchart of an exemplary process 800 for manufacturing ATM 110 consistent with disclosed embodiments. One or more steps may be added or deleted from process 800. At step 810, process 800 may include applying substance 410 to interior housing surface 230. Substance 410, alone or in combination with interior housing surface 230, may form electrical component 405 (e.g., a capacitor and/or piezoelectric element). Additionally, at steps 820-860, process 800 may include coupling a detection circuit comprising components, such as electrical property sensor 310, signal generator 315, sound sensor 320, pressure sensor 330, memory device 580, processor 570, or various other components to electrical component 405 (e.g., substance 410 and/or interior housing surface 230). The detection circuit components may be used to perform the various steps associated with process 600 or process 700, described above.

Although the disclosed embodiments have been described in relation to ATM 110, other products may also be designed to disclose the same features as disclosed above. The other products may relate to any product that is used to secure something inside of the product. To illustrate the far-reaching range of possible products, a few example products follow:

- security devices, such as safes, vaults, fireboxes, jewelry boxes, etc.;
- transportation devices, such as car doors, trunks, etc.;
- electronic devices, such as computers, phones, etc.; and
- entry devices, such as smart locks, doors, cockpits, garage doors, etc.

The described techniques may be varied and are not limited to the examples or descriptions provided. In some embodiments, some or all of the logic for the above-described techniques may be implemented as a computer program or application, as a plug-in module or sub-component of another application, or as hardware components.

Moreover, while illustrative embodiments have been described herein, the scope thereof includes any and all embodiments having equivalent elements, modifications, omissions, combinations (e.g., of aspects across various embodiments), adaptations and/or alterations as would be appreciated by those in the art based on the present disclosure. For example, the number and orientation of components shown in the exemplary systems may be modified. Further, with respect to the exemplary methods illustrated in the attached drawings, the order and sequence of steps may be modified, and steps may be added or deleted.

Thus, the foregoing description has been presented for purposes of illustration. It is not exhaustive and is not limiting to the precise forms or embodiments disclosed. Modifications and adaptations will be apparent to those skilled in the art from consideration of the specification and practice of the disclosed embodiments. The claims are to be interpreted broadly based on the language employed in the claims and not limited to examples described in the present specification. Accordingly, the examples presented herein are to be construed as non-exclusive. Further, the steps of the disclosed methods may be modified in any manner, including by reordering steps and/or inserting or deleting steps.

Furthermore, although aspects of the disclosed embodiments are described as being associated with data stored in memory and other tangible computer-readable storage mediums, one skilled in the art will appreciate that these aspects can also be stored on and executed from many types of tangible computer-readable media, such as secondary storage devices, like hard disks, floppy disks, or CD-ROM, or other forms of RAM or ROM. Accordingly, the disclosed embodiments are not limited to the above-described examples but, instead, are defined by the appended claims in light of their full scope of equivalents.

What is claimed is:

1. An automated teller machine (ATM), comprising:

a housing comprising an interior surface;

a substance adhered to the interior surface, the substance comprising a piezoelectric element; and a detection circuit coupled to the substance, the detection circuit being configured to:

receive a response pattern generated by the piezoelectric element based on a vibration of at least one component within the ATM;

compare the response pattern to a stored signature corresponding to an expected vibration pattern of the at least one component to detect a vibration pattern indicative of intrusion, the stored signature being derived by the ATM from vibrations of the at least one component within the ATM occurring during a calibration period; and generate, based on the comparison detecting a vibration pattern indicative of intrusion, an indication of an intrusion into the housing.

2. The ATM of claim 1, wherein the substance comprises a coating adhered to the interior surface.

3. The ATM of claim 2, wherein the coating is adhered to an entirety of the interior surface.

4. The ATM of claim 1, further comprising a transmitter coupled to the detection circuit, the transmitter transmitting an intrusion alert signal upon generation of the intrusion indication.

5. The ATM of claim 1, wherein the detection circuit comprises an electrode coupled to the piezoelectric element.

6. The ATM of claim 1, wherein the piezoelectric element comprises at least one of a crystalline material, a ceramic material, or a polymer.

7. The ATM of claim 6, wherein the piezoelectric element comprises a plurality of piezoelectric particles suspended in a base material.

8. A method for detecting an intrusion into an automated teller machine (ATM), the method comprising:

applying a substance to an interior surface of a housing of the ATM, the substance comprising a piezoelectric element;

coupling a detection circuit to the piezoelectric element;

receiving, using the detection circuit a response pattern generated by the piezoelectric element based on a vibration of at least one component within the ATM;

comparing the response pattern to a stored signature corresponding to an expected vibration pattern of the at least one component, the stored signature being derived by the ATM from vibrations of the at least one component within the ATM occurring during a calibration period; and generating, based on the comparison, an indication of an intrusion into the housing.

9. The method of claim 8, wherein applying the substance comprises coating the substance onto the interior surface.

10. The method of claim 8, further comprising transmitting an intrusion alert signal upon generation of the intrusion indication.

11. One or more non-transitory computer-readable media comprising instructions that, when executed by one or more processors of an automated teller machine (ATM), cause operations comprising:

receiving a response pattern generated by a piezoelectric element of the ATM based on a vibration of at least one component of the ATM;

comparing the response pattern to a stored signature corresponding to an expected vibration pattern, the stored signature being derived by the ATM from vibrations of the at least one component of the ATM occurring during a calibration period; and generating, based on the comparison, an indication of an intrusion into a housing of the ATM.

12. The media of claim 11, wherein generating the intrusion indication comprises generating the intrusion indication based on the comparison detecting a vibration pattern indicative of intrusion.

13. The media of claim 11, wherein the at least one component comprises an actuator of the ATM, and wherein the first response signal pattern is generated by the piezoelectric element based on a vibration of the actuator.

14. The ATM of claim 1, wherein the at least one component comprises a mechanical component of the ATM, and wherein the response pattern is generated by the piezoelectric element based on a vibration of the mechanical component.

15. The ATM of claim 14, wherein the mechanical component comprises an actuator of the ATM, and wherein the response pattern is generated by the piezoelectric element based on a vibration of the actuator.

16. The method of claim 8, wherein generating the intrusion indication comprises generating the intrusion indication based on the comparison detecting a vibration pattern indicative of intrusion.

17. The method of claim 8, wherein the at least one component comprises a mechanical component of the ATM, and wherein the response pattern is generated by the piezoelectric element based on a vibration of the mechanical component.

18. The method of claim 17, wherein the mechanical component comprises an actuator of the ATM, and wherein the response pattern is generated by the piezoelectric element based on a vibration of the actuator.

* * * * *